United States Patent [19]

Yamamoto et al.

[11] 4,084,959

[45] Apr. 18, 1978

[54] METHOD FOR CONTINUOUS REFINING OF A MOLTEN IRON BASE METAL

[75] Inventors: Satomi Yamamoto; Masataka Yoshii; Teruo Matsuo; Teruo Yokoozi, all of Kitakyushu, Japan

[73] Assignee: Nippon Steel Corporation, Tokyo, Japan

[21] Appl. No.: 750,722

[22] Filed: Dec. 15, 1976

[51] Int. Cl.[2] ..... C21C 3/04; C21C 7/02

[52] U.S. Cl. ..... 75/53; 75/24; 75/46; 75/58

[58] Field of Search ..... 75/46, 52, 24, 53, 60, 75/58

[56] References Cited

U.S. PATENT DOCUMENTS

| | | | |
|---|---|---|---|
| 3,617,257 | 11/1971 | Rouanet | 75/46 |
| 3,702,695 | 11/1972 | Rouanet | 75/46 |
| 3,985,549 | 10/1976 | Rheinländer | 75/46 |

*Primary Examiner*—P. D. Rosenberg
*Attorney, Agent, or Firm*—Wenderoth, Lind & Ponack

[57] ABSTRACT

A molten iron is continuously refined in a refining vessel of a closed type using a flux composed chiefly of an alkali metal compound so as to decrease the content of P and S to a low level. The alkali metal compound is recovered from the evaporating material and slag generated in the refining and is again used in the refining, while such valuable elements as P, V, etc. may be recovered.

The molten iron thus refined can be converted into a steel of high quality in a known oxygen steel making furnace substantially by means of decarburization only and without the use of any flux or with a slight amount thereof.

The practice of this invention makes it possible to substantially obviate a substance to be discarded or rejected in the steel making process.

23 Claims, 7 Drawing Figures

(a)

(b)

METHOD FOR CONTINUOUS REFINING OF A MOLTEN IRON BASE METAL

DETAILED DESCRIPTION OF THE INVENTION

Figure 1:
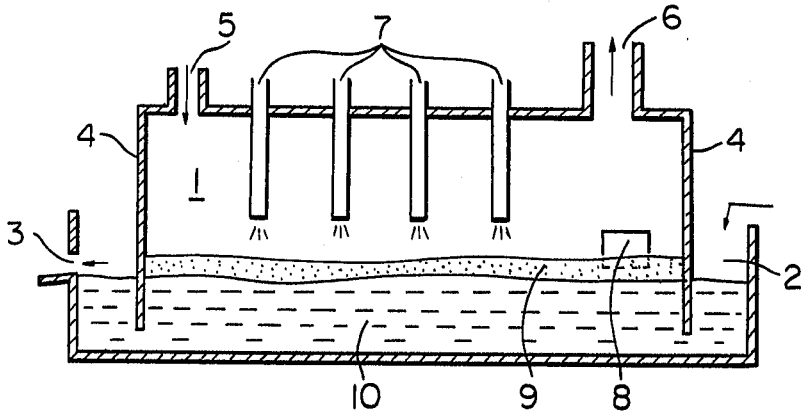

This invention relates to a new refining method wherein a molten iron base metal including a molten pig iron or a molten ferro-alloy such as ferro-manganese, etc. can be refined more effectively than the conventional process.

The key point in refining a molten iron base metal lies in dephosphorization and desulfurization. For example, the dephosphorization of the molten pig iron is generally carried out by forming a basic slag using a flux consisting chiefly of quicklime or CaO while oxidizing the molten pig iron by means of $O_2$ gas or ore, etc. It has widely been practised in an oxygen steel making process using oxygen LD converter process, etc.

The desulfurization in the oxygen steel making process is carried out by distribution of sulfur between the molten pig iron and the slag which has been prepared for use in said dephosphorization. In this case the ability of desulfurization of said slag is not strong. Accordingly, in a case of making a steel in general as well as a case of making a low sulfur steel, a preliminary desulfurization is effected by the use of calcium carbide, sodium carbonate, etc. prior to the oxygen steel making process.

As stated above, in the present oxygen steel making process, the main object of refining is obliged to lie in the dephosphorization. However, there are many problems encountered in the dephosphorization, too.

As the steel materials have recently been used under severe conditions, the ratio of production of a killed steel of high quality is increasing. In the production of a steel of this kind, it is necessary to lower the content of such impurities as P, S, etc. as much as possible and also to add a great amount of alloy elements.

Accordingly, a final refining is often effected in another refining furnace after a crude refining is conducted in an oxygen steel making furnace. Thus, in order to supplement the temperature decrease caused therebetween, the terminal temperature or the temperature at turn down in the oxygen steel making furnace must inevitably be high. Recently many kinds of steels have been produced by the continuous casting process rather than by the ordinary ingot making process. In this case also the temperature at turn down in the oxygen steel making furnace must be made high. This is a decisive disadvantageous condition for promoting the dephosphorization reaction.

The slag consisting chiefly of CaO which is generally used in the oxygen steel making process at present has itself a poor ability for dephosphorization. As a result, it becomes inevitable to use a great amount of slag in order to lower the content of P in the refining which must be carried out at high temperature. However, as the amount of slag used increases, such troubles may happen as (1) the lowering of the yield of iron, (2) the increase of heat loss caused by the increase of the sensible heat of the slag, etc.

Above all, the most trouble is that, although the amount of slag obtained after the present refining process is enormous, the way of utilizing the slag has not been established yet. Accordingly, the slag is usually discarded irrespective of valuable elements contained therein, which gives rise to an undesirable results that the place where the slag is to be discarded becomes limited, that the pollution problems are caused thereby, etc.

It is known that there is a refining method wherein an alkali metal compound is used as a flux instead of CaO, which compound has a stronger affinity with P and S than CaO. As disclosed in German Pat. Nos. 900,458, 941,197, British patent specification No. 782,192, U.S. Pat. No. 2,147,205, French Pat. No. 1,489,570, etc., it is possible to decrease the content of P and S in a molten pig iron simultaneously to a low level if the oxidizing is effected while adding a flux composed chiefly of $Na_2CO_3$ to the molten pig iron, whereby one of the defects incidental to the use of CaO as a flux can be overcome. However, the reasons why this method can not take the place of the refining method using CaO are as follows.

1. The alkali metal compound is apt to evaporate under such high temperature as in the refining of a molten iron base metal, and the evaporating material is harmful to human health.

2. The unit amount of the alkali metal compound to be used increases irrespective of its great refining ability, since it evaporates easily.

3. The alkali metal compound is more expensive than quicklime or CaO.

4. The wear or melt loss of the refractory materials of the refining vessel is great.

5. The slag obtained after refining can not be discarded. When the slag containing alkali metal compound is discarded, the water in which the slag has been dissolved becomes a strong basic solution of pH 13 or more and also various ions dissolve out therefrom. It is thus necessary to effect a costly chemical treatment so as to make it harmless.

It is therefore an object of this invention to provide a refining method of molten iron base metal capable of substantially preventing the emanation of materials to be discarded so that the pollution problems caused by the rejection of the slag can be overcome, which problems have not been solved yet in the conventional refining methods using CaO or alkali metal compounds, etc. as mentioned above.

It is another object of the invention to provide a steel of excellent quality having a smaller amount of such impurities as P, S, etc. than that of the prior art in an efficient manner.

It is a further object of the invention to avoid the various limitations in the production of such good steel which have been required in the conventional steps of manufacturing iron, steel or materials therefor.

According to this invention, there is provided a method for continuous refining of a molten iron base metal which comprises allowing said metal to continuously flow in a refining vessel of a closed type, refining said metal under oxidizing conditions by using a flux mainly composed of an alkali metal compound, and recovering a flux for use in refining a molten iron base metal from the resulting by-product.

According to this invention, there is also provided a method for continuous refining of a molten iron base metal which comprises allowing said metal to continuously flow in a refining vessel of a closed type, refining said metal under oxidizing conditions by using a flux mainly composed of an alkali metal carbonate-containing salt, recovering a substantial amount of alkali metal from the resulting by-product as a carbonate-containing salt and recycling the same as a flux for said refining.

This invention is further described below with respect to a typical embodiment thereof.

Prior to the oxygen steel making process effected by the use of an oxygen LD furance, a preliminary refining apparatus is provided, wherein the refining is carried out using an alkali metal compound having a strong refining ability so as to eliminate such impurities as P, S, and so on. As a result, in the next step of the oxygen steel making process there is an advantage that it is possible to carry out the steel making process substantially only by decarburization without substantial use of any flux. The method of this invention improves the conventional refining method using the alkali metal compound which is known but has not been practiced yet, in the following points.

1. The alkali metal compound used in the refining is reused without discharge thereof from the refining system. It is accomplished by dissolving the refining slag in water, subjecting the aqueous solution and the insoluble residue to the respective proper treatments, thereby recovering such valuable materials as the alkali metal compound, etc., and using the same again in the refining, whereby any rejected material does not substantially appear.

2. In order to easily collect a powdery dust including the alkali metal compound emanating at the time of the refining, an iron base metal in a molten state is refined in a refining vessel of a closed type. The powdery dust thus collected is reused in the refining.

3. In order to keep the amount of the expensive alkali metal compound used at minimum and prevent the spalling loss of the refractory materials, the molten iron base metal is continuously supplied from one end of the refining vessel, which is then allowed to flow inside the vessel during the refining.

The method of this invention is different from the above stated patents relating to the method of refining of the molten iron base metal using the alkali metal compound in the points hereinafter described. The German Pat. Nos. 900458 and 941197, the British patent specification No. 782,192 and the U.S. Pat. No. 2,147,205 only disclose the refining of a molten pig iron under oxidizing conditions using $Na_2CO_3$, etc. and are entirely silent about the recovery of the alkali metal compound in a form capable of being used again in the refining from such by-product as the slag, evaporated material, etc. emanating during the refining as disclosed in this invention. The French patent 1489570 discloses the steps of refining the pig iron using the soda ash and sodium sulfate as the oxidizing agent; and using the slag as produced as fertilizer, detergent or pellet bonding agent, while subjecting the slag to a suitable treatment so as to recover only $Na_2S$ included in the slag as the sodium sulfate. The method of this invention is entirely different from this and other prior patents in that (1) the alkali metal compound which has been used for refining is recovered from the by-product and it is again used for refining, so that so far as the alkali metal compound is concerned a closed circuit, as it were, is constituted and that (2) the compound to be recovered is a carbonate-containing salt, etc. Thus, in the method of this invention, a closed circuit for the alkali metal compound is a pre-requisite. Accordingly if the sulfate radical, nitrate radical, hydrochloride radical is used as the anion to be bonded to the alkali metal, it is unavoidable for these to be accumulated in the closed circuit, which gives rise to not only various troubles in the refining but also such adverse effects as the lowering of yield of recovery of the alkali metal compound or the increase of wear of the refractory materials. As is obvious from this, the method of this invention has the features that the harmless carbonate radical, hydroxide radical, etc., which is easily discharged in the air by thermal decomposition is utilized and that the valuable elements in the slag are recovered under the pre-requisite of refining for recovery of the alkali metal compound and P is recovered in the form of calcium compound which has the widest application. In this way, only the merit of the refining using the alkali metal compound can be utilized according to the closed-circuit-refining of this invention. The practice of refining of this invention is chiefly directed to the "dephosphorization". Therefore, this invention is explained chiefly with respect to the dephosphorization.

The step of the dephosphorization comprises oxidizing P contained in the molten iron base metal to $P_2O_5$, and allowing the slag to contain the strongly acidic $P_2O_5$ by combination with basic compound added from flux, whereby the content of P in the molten iron base metal may be lowered.

In the practice of this invention, instead of CaO which has conventionally been used, the alkali metal compound which is more basic than CaO is used to fix $P_2O_5$ as the alkali salt, which makes it possible to lower the content of P in the molten iron base metal to an extremely lower level. The compound used as a flux is most suitably an alkali metal carbonate-containing salt, which includes the alkali metal carbonate, or the alkali metal bicarbonate, or the mixture or complex thereof. Above all, sodium carbonate-containing salt which is cheap and easily available from plentiful resources may be used singly or as the main component with another alkali metal compound, for example, hydroxide, etc. In addition, a compound and/or mixture of (a) the alkali metal compound and (b) the oxide of Ca, Fe, Mn, Si or Al, etc. can be used as a flux.

However, these additives other than the alkali metal carbonate-containing salt should be incorporated in an amount of not more than 50%, since they act to lower the yield of recovery of the alkali metal compound when the latter is recovered from the by-product of refining at a later stage.

The flux is usually used in a solid state but it may be used in a molten state as the case may require.

In view of the fact that the alkali metal compound is more expensive than the CaO which has conventionally been used, the amount of the compound used must be maintained as low as possible. Moreover, for the purpose of keeping the cost of recovery at minimum when the alkali metal compound is recovered from the by-product, it is necessary to make the amount of the emanating by-product as small as possible and yet to conduct the collection of the by-product itself perfectly.

A refining method which is most effective therefor is a continuous refining method using a refining vessel of a closed type. The alkali metal compound is apt to evaporate at high temperature, and thus in the normal refining temperature of the molten iron base metal, 1/10 to 1/2 of the amount added evaporates without substantial participation in the refining. In the practice of this invention, the evaporating material is collected as one of the by-products of the refining in such a form as not to entrain or mix the other impurities therein. That is, a great amount of evaporating material generated inside the refining vessel of a closed type wherein a partition wall has been immersed into the molten iron base metal to close off the atmosphere therefrom is collected substantially perfectly by the use of a dust-collecting machine of high ability which exclusively belongs to the refining vessel. The powdery dust thus collected which consists chiefly of the evaporating material of the alkali metal compound and Fe oxide is again used in the refining as a flux component, as it is or after processed by means of a granulation unit into a pellet or briquette form.

The more important by-product emanating from the refining using the alkali metal compound is the slag. The slag after refining contains a lot of impurities entrained from the molten iron base metal. It can not be reused in the refining as it is, as distinguished from the evaporating material. Consequently, it is necessary to eliminate such undesirable components as P, S, $SiO_2$, etc. in the refining reaction or such components as not participating in the reaction from the slag once used for refining. The step of eliminating such components necessitates large scale equipment and a large amount of water and thus occupies substantially all of the cost required when the alkali metal compound is recovered from the by-product.

When this invention is practised, the amount of the slag produced is made as small as possible and the cost of recovering the alkali metal compound from the slag is kept as low as possible. In order to accomplish this, a continuous refining process is carried out which provides an excellent efficiency of contact between the metal and the slag.

In more detail, a molten iron base metal is continuously supplied from one end of a closed type refining vessel while a flux is supplied as the metal bath is oxidized, whereby a counter-current or concurrent refining is effected. The oxidizing of the metal bath may be effected by the use of at least one member of the group consisting of $O_2$ gas, air and iron ore, wherein they may be blown not only from the upper part but also side wall or bottom part of the refining vessel.

The molten iron base metal refined in the above way is separated from the slag and may be passed, as it is or after stored once in a mixer, into a known steel making furnace.

The slag containing the alkali metal compound which is continuously discharged from the refining vessel is passed to the slag treatment step. In view of the fact, in this treatment step, that the slag is water-soluble and that it consists essentially of two different groups of elements, that is, (a) the elements which go chiefly to the aqueous solution and (b) the elements which will remain as the insoluble residue, the respective suitable treatments are effected. Thereafter, such valuable materials as the alkali metal compound etc. are recovered therefrom in a form adapted for use in the refining.

The alkali metal goes chiefly together with P to the aqueous solution, while Fe and Mn almost remain in the insoluble residue. The behavior of Si and S is intermediate therebetween. As a means to recover the alkali metal from the aqueous solution, P or other impurities which are dissolved in the aqueous solution are removed, and thereafter the aqueous solution is subjected to the chemical treatment to recover the alkali metal as the compound. Alternatively, said aqueous solution may be subjected to the chemical treatment without removal of said P or other impurities dissolved therein. For example, it can be separated and recovered from the solution as a precipitate of an alkali metal carbonate-containing salt, by, for example, blowing $CO_2$ into the aqueous solution. This salt containing an alkali metal carbonate can be used again, as it is or after calcined, or after remelting in the refining of the molten iron base metal.

From the insoluble residue having oxides of Fe, Mn and Si as the main components, S may be removed as required. Thereafter the water content in said residue is decreased by means of dehydration or drying so that it may be shaped into a small lump, which is then charged again into the refining vessel. In this case, the oxides of Fe, Mn are reduced by virtue of the C in the molten iron base metal and recovered as the metal, while Na and Si are entrained into the slag, which then contribute to the refining.

The preferable embodiment of the refining method according to this invention is further described with reference to the drawing.

FIG. 1 is a typical example of the refining vessel of a closed type suitable for use in the method of this invention.

Figure 2:
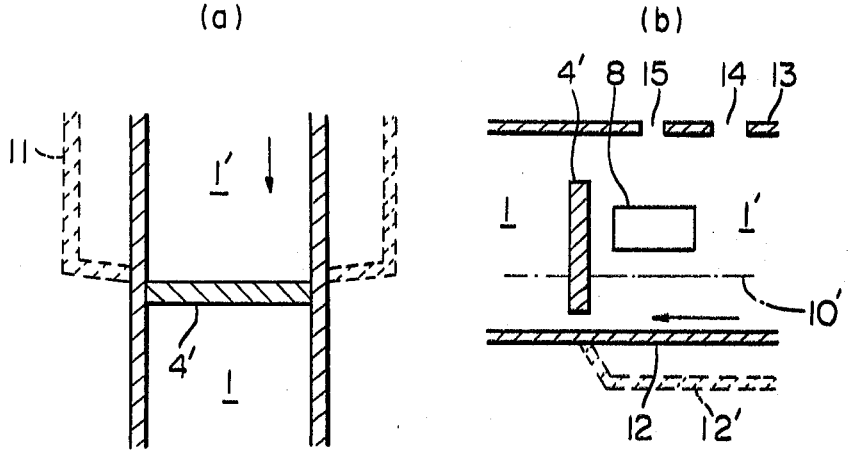
Figure 3:
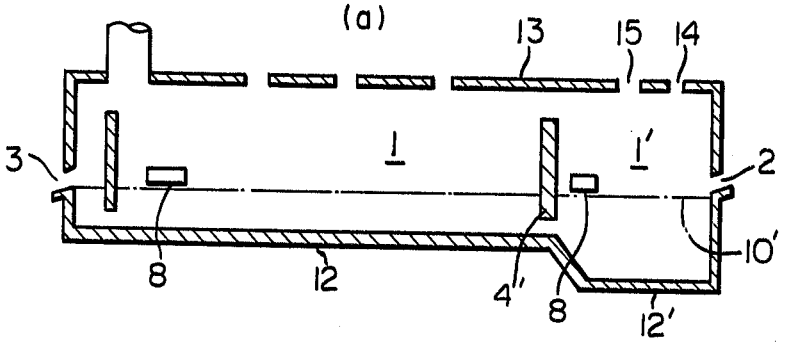
Figure 3:
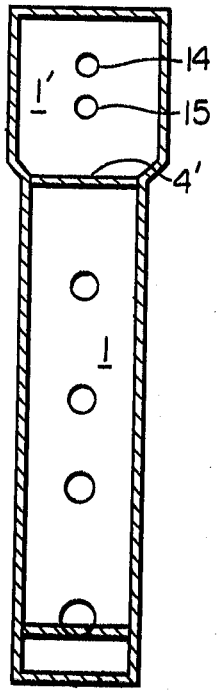

FIG. 2(*a*), (*b*) and FIG. 3 (*a*), (*b*) show examples of the chamber exclusively used for desiliconization provided adjacently to the refining chamber where dephosphorization and desulfurization are effected.

Figure 4:
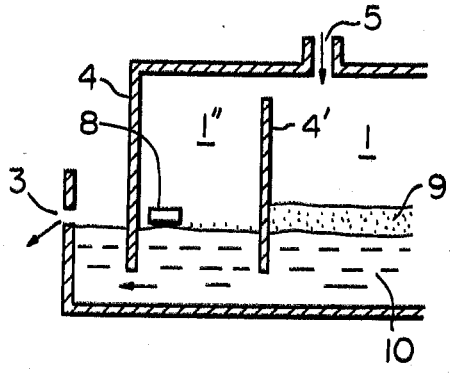

FIG. 4 is an example of the chamber where the separation of the slag and metal is promoted.

In FIG. 1, a refining vessel suitable for practising the method of this invention is shown. It is, as a whole, a trough- or gutter-like structure having a rectangular section, the interior wall of which is lined with a refractory material. Inside the refining vessel, a refining chamber 1 of a closed type is formed, and two separate chambers are also provided on both side of said chamber 1 along a longitudinal or flow direction of the vessel. One of said separate chambers constitutes an inlet 2 for the molten metal and the other an outlet 3 therefor.

Vessel walls 4 for partitioning the refining chamber 1 from the inlet 2 and from the outlet 3 are positioned such that the lower end thereof does not touch the bottom of the vessel, giving an opening therebetween. During the refining the lower end of the vessel wall 4 is immersed into the molten metal bath, whereby the inside of the chamber 1 can be shut down from the outside air and maintained under tightly sealed or closed condition, while the slag 9 can be separated from the molten metal bath 10.

On the upper part of the refining vessel, there are provided one or more than one hole 5 through which such flux as the alkali metal compound is charged. Also an exhaust pipe 6 is mounted thereon, to which a dust collector not shown is connected to thereby recover evaporated alkali metal compound emanating during the refining. On the upper wall or the side wall or the bottom wall of the refining vessel, there is provided at least one lance or tuyere 7, through which $O_2$ or $N_2$ or air as required may be blown to oxidize the molten metal as well as agitate and the metal and the slag. Alternatively, some porous plugs are provided on the bottom wall of the vessel and an inert gas is blown into the vessel therethrough so as to agitate the metal and the slag.

On a predetermined position on the side wall of the vessel, at least one tap hole 8 is provided, through which the slag is discharged. In order to proceed fully with the refining inside the vessel, the counter-current system wherein the flow of the molten iron base metal and that of the slag become opposite to each other is more effective than the concurrent system. In this case, the flow of the slag should be directed to the right side against the flow of the molten metal which is directed to the left side in FIG. 1. Therefore, the hole 5 for introducing flux, etc. is provided on the upper wall in the down stream portion of the vessel and the tap hole 8 for discharging the slag is provided in the upstream portion thereof. The tap hole 8 should preferably be positioned such that the lower surface thereof is about 5 cm higher than the surface of the molten metal.

Still more preferable examples of the refining vessel are shown in FIG. 2 (*a*), (*b*) and FIG. 3(*a*), (*b*).

The purpose of the vessel is to effect the dephosphorization and desulfurization by means of the alkali metal compound more effectively. It functions to preliminarily remove by oxidation the Si in the molten iron base metal before the dephosphorization and desulfurization so as to control the value of Si of the molten metal to a suitable level.

Generally in case of refining under oxidizing condition the molten iron base metal where Si and P are co-existing, only the Si is selectively oxidized to produce a slag and prevent the oxidizing of the P if the content of the Si is much higher than the P. On the other hand, if the content of the Si is very low, the amount of the $SiO_2$ produced which acts to allow the alkali metal compound to exist in the slag in a stable form becomes small, whereby the condition of dephosphorization is also deteriorated.

As is seen from the above, it is necessary to adjust the Si to a suitable amount before dephosphorization in order to effect dephosphorization more effectively. This range of amount of Si may be less than 0.4%, e.g. 0.10 to 0.40%, and most preferably 0.15 to 0.30% in case of P in the molten iron base metal being 0.08 to 0.20%.

The refining vessel as shown in FIGS. 2 and 3 is divided into two chambers by means of a partition wall 4', wherein a desiliconization chamber 1' is provided in the upstream of the molten iron base metal and a dephosphorization and desulfurization chamber or a refining chamber 1 is provided in the downstream of the molten iron base metal. These two chambers are connected with each other under the partition wall but the slag on the metal bath is separated by means of said partition wall.

The width of the metal bath in the desiliconization chamber 1' is not necessarily the same as that of the refining chamber 1. It is often profitable to make the width of the desiliconization chamber 1' larger than that of the refining chamber 1 as shown by a dotted line 11 in FIG. 2(*a*) for the purpose of securing the residence time in the former chamber. In case that the amount of desiliconization is large in the desiliconization chamber, the increase in temperature of the molten metal bath in said chamber becomes large. It is thus necessary to throw a coolant into said chamber to cool the metal bath. In order to relieve the shock caused by the coolant thrown into said chamber, it is sometimes necessary to make the depth of the bath of said chamber deeper than that of the refining chamber. In this case it is advisable to lower the bottom 12 of the desiliconization chamber to the level 12' as shown in FIG. 2(*b*), so as to generally provide the total depth of the bath of 50 cm or more. On the side wall of the desiliconization chamber 1' above the surface 10' of the molten metal, there are provided one or more holes 8 for discharging the slag. In addition, there are provided one or more holes 14, 15 at any position on the ceiling 13, the side wall or the bottom of said chamber for charging thereinto flux as CaO and such coolant as scrap, etc. or for blowing thereinto oxygen for desiliconization.

The size of the desiliconization chamber depends upon the amount of Si to be removed and the amount of the molten metal to be treated. The amount of Si to be removed may be determined by the difference between the content (%) of Si in the molten metal charged and the amount (%) of Si required in the refining chamber. This amount of Si required in the refining chamber may preferably be 0.1% to 0.4% as mentioned before.

According to the inventor's findings, it is optimum that the residence time of the molten metal in the desiliconization chamber is 0.5 to 3.5 minutes per 0.1% of Si removed. If the time is shorter than this, the amount of oxygen to be supplied must be increased which results in severe metal sticking, or the number of lances to be used must be increased which necessitates enlargement of the length of the desiliconization chamber. In any case, it is undesirable from the standpoint of costs for equipments and refractory materials. On the other hand, if the residence time is longer than that, the size of the desiliconization chamber must be enlarged which also gives undesirable results.

In order to fulfil desiliconization in the desiliconization chamber, it becomes necessary to add a quicklime so as to lower the viscosity of the slag. The amount of the quicklime to be added can be determined based on the formula of the basicity of slag $(CaO)/(SiO_2) = 0.7$ to 1.0.

It has now been clarified that the almost expected effect of refining can be realized by the use of the refining vessel as described hereinabove. However, there is still one problem left as to the perfect separation of the slag from the molten metal bath after refining. In the refining vessel set out above, the slag is separated from the metal bath only through one partition wall 4 in the downstream of the bath as shown in FIG. 1, which gives rise to imperfect separation of the slag from the bath. If the separation is imperfect, there is a fear that such impurities as P, S, etc. contained in the slag may be entrained in the molten metal in the next step, or the alkali-containing slag may injure the refractory materials in the next step in case the alkali metal compound is used in the refining.

The refining vessel shown in FIG. 4 is intended to overcome the above stated problem. In FIG. 4, the numeral 1 is a refining chamber, and 3 is an outlet or tap hole for discharging the molten metal such as pig iron. The numeral 4' is a partition wall provided inside the refining chamber 1 in the downstream thereof. The numeral 1" shows a slag separation chamber provided between the partition wall 4' and the tap hole 3. The numeral 8 is a slag tap hole provided inside said chamber 1" at a suitable position.

The slag separation chamber 1" may be made in any suitable space with the vessel wall 4 formed integrally with the body of the vessel as shown. The form of the bath inside said separation chamber 1" varies with the specific gravity and property of the slag used in the refining, and it is suitable to design it so that the residence time of the molten iron base metal in the separation chamber is 0.5 to 3.0 minutes.

As for the refractory material, it is desirable that at least a part which contacts with the molten slag should be a dense material having a small porosity, enough to avoid the wear or melt loss, for example an electro cast brick such as alumina, magnesia, etc.

This dense refractory material is generally costly. In order to decrease the amount of its use as far as possible, it is necessary to make the effective area of the refining vessel as small as possible. However, the amount of the flux necessary to give a predetermined effect of refining is increased as the effective area of the vessel is decreased. The condition for minimizing the sum of costs for the refractory materials and flux is such that the ratio of the effective area $m^2$(length × width of the vessel) to the unit of molten metal flow ($t$/min) equals 4 to 10, more preferably 5 to 7.

The main factors having an effect upon the result of refining are the temperature and the amount of the alkali metal carbonate-containing salt added. It is preferable that the refining temperature should be not more than 1500° C for full dephosphorization and desulfurization. If the temperature is kept below 1500° C, the amount of the alkali metal compound evaporated and the wear or melt loss of the refractory material becomes small. In order to accomplish this, scraps or iron oxides may be charged so as to control the temperature.

The amount of the alkali metal carbonate-containing salt added can be calculated by the following formula. That is, it is necessary that the ratio of the amount (mole) of the alkali metal oxide in the alkali metal carbonate-containing salt to the amount (mole) of $SiO_2$ and $P_2O_5$ removed by oxidation inside the refining vessel is 2 to 7. If this ratio is 3 to 4, the refining effect is great while the loss of the alkali metal evaporated is small with a desirable result.

Mole ratio of alkali metal oxide/($SiO_2 + P_2O_5$) = 2 to 7.

In case that a molten pig iron which is a typical example of the molten iron base metal is refined under oxidizing condition by the use of sodium carbonate or soda ash which is most advantageous in cast according to the refining method of this invention, a slag having a composition of 10 to 60% Na, 1 to 15% Si, 0.5 to 22% P and 0.1 to 2% S can be obtained. This slag is of a vitreous and substantially unbreakable nature and is thus allowed to flow in a molten state on a cooled metal plate from the refining vessel so that it will be cooled rapidly in a form of thin flake. It is possible to make the slag easily breakable by connecting a cooling means to a metal plate and keeping said plate at a temperature of not more than 300° C. The slag is crushed mechanically to pieces of a size of 30 mm square to 100 mm square while cooled, and then stored in a hopper. This slag is of a hygroscopic nature, which necessitates the use of a closed type hopper. Small pieces of the slag which are taken out at times from the hopper are charged to a wet type crusher such as a ball mill, etc., where they are crushed in finer pieces and dissolved in water. As a result, a water-soluble component in the slag melts in water and a slurry having an insoluble residue suspended is thus obtained.

The water used for dissolving the slag may be not only an ordinary water to be used in industry but also a water containing Na such as a dust-collecting water for collecting an evaporated material emanating inside the refining vessel by a wet type dust collector. Most preferably, it may be a water used for recovering Na as a carbonate-containing salt in the rear step, which can be recycled for dissolving the slag. This recycled water contains 1 to 20% of sodium carbonate containing salt. When it is used twice to 20 times, preferably thrice to 10 times, the amount by weight of the slag, to dissolve said slag, more than 80% of Na, P is extracted into the aqueous solution. As for Si, it goes into the aqueous solution as a water-soluble silicic acid in a greater ratio as the pH of the solution is high. However, in case that the pH of the solution is 12 or less, a greater part of Si will be deposited as an insoluble silicic acid, which can thus be separated from the solution. The pH of the solution depends upon the ratio of the slag to the solvent, the kind or concentration of the carbonate-containing salt in the solvent. If desired, it is possible to increase the rate of deposition of Si by adding a weak acidic substance such as carbon dioxide, etc. to adjust the value of pH. As the value of pH becomes lower, the deposition of Si becomes more perfect. It is, however, undesirable that pH becomes less than 9, because Na is also deposited in this case. The behavior of S in the solution may vary with the pH or oxidation conditions in the solution. In case that an oxidizing agent such as air or oxygen, etc. is added to the aqueous solution in the pH range of 12 to 9 wherein it is possible to deposit and separate a greater part of Si, about 70% of S becomes insoluble and is thus deposited. The deposited Si and S can be filtered off from the aqueous solution singly or in combination but it takes a long time to filter the same because the deposited material is extremely fine. The step of filtering can be simplified by adjusting the pH value under the slurry conditions in which the insoluble residues co-exist, adding thereto an oxidizing agent and thereafter filtering off the deposited Si and S together with the insoluble residues. When the deposited Si and S and the insoluble residues are separated from the slurry of the slag, an aqueous solution containing a greater part of Na and P and a smaller part of Si and S is obtained. If at least one alkaline earth metal compound (oxides, carbonate, nitrate and hydroxide), most suitably $Ca(OH)_2$, is added to this aqueous solution, P is deposited as the alkaline earth metal (e.g. calcium) phosphate, which can be removed. In this case, if the temperature of the solution is set to 20° C to 80° C and the $Ca(OH)_2$ in an amount of 1 to 1.2 equivalent of pin the solution is added, suitably as a lime milk, more than 80% of the P can be removed. This deposited calcium phosphate is of a high quality containing substantially no Si or an excess amount of $Ca(OH)_2$, etc., which can thus be utilized effectively as a material for fertilizer and so on.

By means of the above described operations, at least 80% of Si and P and at least 70% of S in the aqueous solution can be separated and removed.

As the solution from which the deposited S, Si and P have been filtered off is a Na-containing solution with little impurities, it is passed to a known reactor for carbonation where it is contacted with $CO_2$ gas so as to deposit Na as a Na carbonate-containing salt, for example $NaHCO_3$ or $Na_2CO_3$. The factors affecting the efficiency for recovering the carbonate-containing salt in this case are the temperature of the solution and the Na concentration. The recovery efficiency is increased as the temperature of the solution becomes low or as the Na concentration becomes higher. It is effective for enhancing the recovery efficiency to increase the Na concentration by evaporating a part of the solution before addition of $CO_2$.

The deposited Na carbonate-containing salt may be filtered off in a usual way or it can be separated by evaporating the solution to dryness.

It is not always necessary to carry out the above operations in the way as described. For example, it is possible to deposit Si by adjusting pH after depositing P and filtering these simultaneously so as to enhance the filterability, or it is also possible to separate P from the solution after deposition of Na.

The solution from which the Na carbonate-containing salt has been filtered off can be returned again to the step of dissolving slag or to the step of carbonation for recycling. In this course of recycling, some impurities or valuable elements such as V, W, etc. become concentrated, among which the concentrated S causes troubles in the refining. Thus, a part of the recycled or circulated water may be taken out of the system and instead a renewed water is supplemented from outside to dilute the S in the solution. Alternatively, the S can be eliminated by applying to at least a part of the recycled water a known ion-exchange membrane electrolysis method or a submerged combustion method. Thus it is possible to keep the S in the recycled water at a low level by carrying out a submerged combustion method of a reducing character with respect to about 10% of the recycled water using a propane gas, etc. as a combustion agent with air ratio of 0.6 to 0.8. When in this way the concentration of impurities in the solution is lowered and the Na carbonate-containing salt is filtered, it is possible to steadily recover a Na carbonate-containing salt having little impurities by effecting a full dehydration using, for example, a vacuum dehydrating machine. The amount of P and S in the Na carbonate-containing salt thus recovered is not more than 1%, respectively, and it has been ascertained that the result of refining is not affected at all even if the total amount thereof is used. The valuable elements such as V, W, etc. as concentrated in the recycled water can also be recovered by carrying out a suitable treatment.

On the other hand, the weight of the filtered residue which is a mixture of (a) the insoluble component such as Fe, Mn, Si, etc. produced when the slag is dissolved in water and (b) the deposited Si and S is 30 to 50% of the weight of the slag. It is thus necessary to make use of the filtered residue. It is in a concentrated slurry condition consisting of fine iron oxide and insoluble silicate, etc. and it is thus very difficult to fully carry out the filtering and dehydration thereof. Accordingly there is still 40 to 50% water remaining therein even after the filter press operation using high pressure, and moreover it is unavoidable that there is 5 to 25% Na remaining in the filtered residue which would otherwise be all entrained in the aqueous solution. It is possible to subject this residue to a chemical treatment so that Fe, Mn, Na or other valuable elements may be recovered singly, but it is not preferable because of its high cost. The most desirable and cheapest way of recovery is to remove S in the residue by the use of a known solvent, if necessary, effecting a full dehydration of the residue with or without the subsequent drying, and charging the same again into the refining vessel, whereby Fe and Mn are recovered in the metal and Si and Na are recovered in the slag. Since the contents of P and S as impurities are small, they do not raise any problem even if the residue is charged again. However, the content of Si is gradually accumulated in the slag in the course of circulation of the residue to such an extent that it is not proper for the refining. In order to prevent the concentration of Si in the slag, it will suffice to use in the refining a molten iron base alloy having the low content of Si. For example, the Si content therein may be preliminarily lowered in the blast furnace or other steps. As set out hereinbefore, a refining vessel used in this invention which may have a separate desiliconization chamber will also act effectively in this respect.

By conducting the above-stated recovery operations, a greater part of the slag can be rendered capable of being used again for the refining. In other words, in the practice of this invention, the alkali metal compound is recovered from the by-products of the invention which includes the slag and the evaporated material, and said compound is reused in the refining as the flux. These operations are repeated, and the slight amount which has been lost during the recovery operation is supplemented from outside. This repeated operation make possible the substantially perfect recycled use of the alkali metal compound whereby all problems caused by the high cost of the flux and the pollution troubles based on the discarded by-products which have heretofore been obstacles to the refining method using the alkali metal compound can be avoided.

Examples of this invention are described below.

EXAMPLE 1

An oxidation refining is conducted while a molten pig iron is continuously supplied in a rate of 30 T/H to a trough-like, closed type refining vessel with the bath configuration of 300 mm width × 300 mm depth × 13000 mm length.

The vessel has a desiliconization chamber of 1,500 mm long in the upstream of the flow of the pig iron and also has a dephosphorization and desulfurization chamber of 10,000 mm long and a slag separation chamber of 1,500 mm long with partitioning walls therebetween in the downstream of said flow. The ratio of the effective area ($m^2$) of the dephosphorization and desulphurization chamber to the unit amount (ton/min) of the molten pig iron treated is 6.0. The refractory material used for lining the interior of the refining vessel is that of high alumina system containing 94.8% of $Al_2O_3$ and 5.2% of impurities composed mainly of $SiO_2$.

In the desiliconization chamber, the amount of $O_2$ supplied and the amount of CaO charged are adjusted according to the content of Si in the molten pig iron so that the content of Si in the outlet of the desiliconization chamber and the flowability of the slag discharged are controlled. Moreover, while the temperature inside the desiliconization chamber is continuously measured, small lumps of scraps are charged so as to maintain the outlet temperature of said chamber at about 1440° C.

In the dephosphorization and desiliconization chamber, the sodium carbonate of commercial grade in briquette form is charged from the inlet hole for flux positioned in the ceiling in the downstream side of the flow of pig iron, so that the amount of $Na_2O$(mole) is four times the sum (mole) of $SiO_2$ and $P_2O_5$ to be removed, while the $O_2$ gas is blown into said chamber from the upper-blow lance positioned in the ceiling of said vessel, whereby the oxidizing refining is conducted. Four $O_2$ lances are arranged in series along the longitudinal direction in the dephosphorization and desulfurization chamber with 1000 mm distance each, and inclined toward the upstream of the flow of molten pig iron at an angle of 30° from the vertical line. There are three holes in each lance nozzle and the total $O_2$ supplied amounts to 450 $Nm^3/H$ for all four lances. Also in the outlet of the dephosphorization and desulfurization chamber, the temperature of the molten pig iron in the outlet is kept at 1450° C or less by charging ores, if necessary, while said temperature is continuously measured. The molten pig iron as refined is stripped of the slag, discharged continuously from the refining vessel and stored in a mixer. The table below shows the change by time lapse in the composition of the molten pig iron before and after the refining based on the steady state reached.

Table

| Time | Place for sampling | Composition (%) C | Si | Mn | P | S | Temp. |
|---|---|---|---|---|---|---|---|
| 0 | Inlet hole for supplying molten pig iron (a) | 4.2 | 0.61 | 0.42 | 0.120 | 0.041 | 1280° C |
| | Outlet of the desiliconization chamber (b) | 4.0 | 0.18 | 0.31 | 0.100 | 0.040 | 1360° C |
| | Outlet of the dephosphorization & desulfurization chamber (c) | 3.6 | 0.07 | 0.20 | 0.035 | 0.008 | 1450° C |
| 100 hours lapse | (a) | 4.3 | 0.55 | 0.45 | 0.122 | 0.041 | 1290° C |
| | (b) | 4.0 | 0.20 | 0.33 | 0.095 | 0.038 | 1350° C |
| | (c) | 3.5 | 0.06 | 0.19 | 0.032 | 0.009 | 1430° C |

EXAMPLE 2

The molten pig iron refined in the method shown in Example 1 is taken out of the mixer and refined in a 25 t oxygen converter. The condition and the result of the refining in said converter is shown below.

(A) Composition of the molten pig iron charged:

| C | Si | Mn | P | S |
|---|---|---|---|---|
| 3.4/3.6 | 0.05/0.08 | 0.18/0.22 | 0.025/0.035 | 0.008/0.014 |

Temperature: 1330° C/1360° C (B) Amount of the molten pig iron:
22.5 to 25.0 T/ch.

(C) Amount of scrap:
0 to 2.5 T/ch.

(D) Amount of CaO charged:
1.0 to 10.0 Kg/T-molten pig iron (E) Velocity of oxygen
Supplied: 5000 $Nm^3/H$ (F) Nozzle: Three holes (G) Composition of steel at turn down (%)

| | C | Si | Mn | P | S |
|---|---|---|---|---|---|
| (1) | 0.05 | — | 0.16 | 0.015 | 0.009 |
| (2) | 0.09 | — | 0.18 | 0.009 | 0.007 |
| (3) | 0.28 | — | 0.19 | 0.011 | 0.009 |
| (4) | 0.50 | — | 0.18 | 0.013 | 0.008 |

EXAMPLE 3

Various molten pig irons are refined under the condition of Example 1. Powdery dusts consisting chiefly of the evaporated materials of Na and Fe emanating from the closed type refining vessel are collected by the dry type dust collector. Its composition is shown below in comparison with the composition of the soda ash prior to use in the refining.

| Composition (%) | Na | Fe | P | S | C |
|---|---|---|---|---|---|
| Soda ash | 43.4 | <0.05 | <0.05 | <0.05 | 11.3 |
| Powdery dust | 29.5 | 31.0 | 0.31 | 0.71 | 1.2 |

The amount of the powdery dusts emanating is about 10 Kg/T-molten pig iron per hour. About 1/5 of the soda ash charged is evaporated. 8.5% of water is mixed with the dust, which is then shaped in a pelletizer to make spherical granules of 5 to 10 mm dia. To these granules, commercial grade soda ash of other origin is mixed and the resulted material is used again in the refining of molten pig iron under the conditions of Example 1.

| Kind of soda ash | Mixing ratio | Amount of $Na_2CO_3$ used |
|---|---|---|
| Powdery dust mixed | 20% | 40Kg/T-molten pig iron |
| Powdery dust not mixed | 0% | " |

| Composition after refining (%) C | Si | Mn | P | S |
|---|---|---|---|---|
| 3.6 | 0.07 | 0.19 | 0.034 | 0.009 |
| 3.6 | 0.08 | 0.19 | 0.031 | 0.008 |

EXAMPLE 4

The alkali metal-containing slag continuously discharged from the refining vessel in the course of refining of the molten pig iron under the conditions shown in Example 1 is rapidly cooled on a rotatable iron disc plate provided with a cooling apparatus. Then the slag is broken into smallpieces, which are then introduced into a wet type crusher of a closed type and further pulverized into finer pieces while dissolved in water to separate the insoluble residue by the use of the filter press. As for the water for dissolving the slag, a liquid obtained after depositing and separating the Na carbonate-containing salt from the aqueous solution in the subsequent step is used in an amount of five times that of the weight of the slag, wherein the behavior of each element in the slag is shown in the Table below.

The average composition of the slag used for dissolution is as follows:

| Na | Si | P | S | Mn | Fe |
|---|---|---|---|---|---|
| 36.5 | 7.1 | 2.4 | 1.0 | 4.0 | 2.8 |

Table

| Water for dissolution | Condition | Distribution (%) Na | Si | P | S | Fe | Mn | Al |
|---|---|---|---|---|---|---|---|---|
| Na-salt separated liquid | To aqueous solution | 90 | 14 | 93 | 30 | 0 | 0 | 0 |
| | To insoluble residue | 10 | 86 | 7 | 70 | 100 | 100 | 100 |

EXAMPLE 5

When the slag is dissolved in the way as shown in Example 4, air or $CO_2$ is blown into the liquid from the lower part of the wet type crusher of a closed type. The change of the composition of the solution in this case is shown below.

| Brown gas | pH | Na | Si | P | S(g/l) |
|---|---|---|---|---|---|
| None | 12.2 | 112 | 2.0 | 3.6 | 2.2 |
| Air | 12.2 | 112 | 2.0 | 3.6 | 0.7 |
| $CO_2$ | 10.4 | 112 | 0.6 | 3.6 | 1.0 |

EXAMPLE 6

The slag is dissolved in water while $CO_2$ and air are blown thereinto in the way described in Examples 4 and 5. The solution obtained after filtering off the insoluble residue therefrom is led to a reaction tower, wherein a lime milk is added thereto with stirring. The composition and pH of the aqueous solution are continuously measured at the inlet and outlet of the reaction tower, to which is added a lime milk in an amount of 1.2 times the chemical equivalent necessary to form calcium phosphate from the phosphate ions in the solution. The change of the composition of the solution is shown below.

| Solvent | Time | pH | Composition of Solution (g/l) Na | Si | P | S |
|---|---|---|---|---|---|---|
| Na-salt separated liquid | After dissolution of slag | 12 | 85 | 1.6 | 4.6 | 1.2 |
| | After addition of lime milk | 12.2 | 85 | 1.4 | 0.8 | 1.2 |

EXAMPLE 7

The solution obtained after separating P, Si and S from the aqueous solution of the slag in the method shown in Examples 5 and 6 is concentrated by means of a multiple effect evaporater until the amount of the liquid is decreased to about ½, which is then cooled to 30° C and thereafter passed to a known reactor for carbonation where $CO_2$ is contacted therewith. The deposited $NaHCO_3$ is separated, followed by dehydration in a vacuum dehydrater, and thereafter charged into a calcination furnace where it is calcined at a temperature of about 200° C to produce a soda ash or $Na_2CO_3$. The composition of the soda ash is as follows:

| Composition (%) | Na | Si | P | S |
|---|---|---|---|---|
| recovered soda ash | 41.0 | 0.30 | 0.13 | 0.22 |
| new soda ash | 43.4 | <0.05 | <0.05 | <0.05 |

This is shaped into spherical granules of 30 mm dia. and used in refining the molten pig iron in the refining method shown in Example 1, the result of which is shown below.

| | Amount of soda ash used | Composition after refining (%) C | Si | Mn | P | S |
|---|---|---|---|---|---|---|
| Recovered soda ash | 40 Kg/T-molten pig iron | 3.5 | 0.07 | 0.20 | 0.033 | 0.009 |
| New soda ash | 40 Kg/T-molten pig iron | 3.6 | 0.08 | 0.19 | 0.031 | 0.008 |

EXAMPLE 8

The liquid obtained after depositing and separating $NaHCO_3$ in the method of Example 7 is reused in the steps of dissolution of slag and recovery of carbonate-containing salt. In this case, a submerged combustion method is applied to a part of the recycled liquid to remove S.

The rate of recovery of the Na carbonate-containing salt and the concentration of S are shown in the following Table.

Table

| Times of recovery | | Ratio of submerged combution method applied to the recycled liquid 0 | 10% | 20% |
|---|---|---|---|---|
| 5 | | 0.12 | 0.08 | 0.04 |

Table-continued

| Times of recovery | | Ratio of submerged combution method applied to the recycled liquid 0 | 10% | 20% |
|---|---|---|---|---|
| 20 | S% in the $NaHCO_3$ | 0.83 | 0.12 | 0.08 |
| 50 | | 1.82 | 0.14 | 0.09 |
| 50 | Na recovery rate | 76.8 | 80.5 | 79.4 |

EXAMPLE 9

The slag is dissolved in water in the method of Example 4. The amount and composition of the insoluble residue obtained are shown below.

| Water for dissolution | Ratio of amount of insoluble residue to amount of slag (%) | Composition of the insoluble residue (%) Na | Si | P | S | Fe | Mn |
|---|---|---|---|---|---|---|---|
| $NaHCO_3$ separated liquid | 41.0 | 11.0 | 14.9 | 0.2 | 0.84 | 13.6 | 7.2 |

The residue is dried under the atmosphere of 200° C to an extent of 4 to 5% water value, and thereafter it is mixed fully with soda ash in the following ratio, which is then shaped into spherical granules of 30 mm dia. in a shaping machine.

Residue: Soda ash = 1 : (2 to 3)

This soda ash mixed with the residue is used in the refining by the method shown in Example 1, which is compared with the result of the refining using the soda ash which is not mixed with the residue.

| Soda ash used | Ratio of residue to soda ash | Amount of soda ash used | Composition after refining (%) C | Si | Mn | P | S |
|---|---|---|---|---|---|---|---|
| Soda ash mixed with residue | 1 : 2 | 40 Kg per 1 ton of molten pig iron | 3.6 | 0.07 | 0.19 | 0.034 | 0.010 |
| " | 1 : 3 | " | 3.6 | 0.06 | 0.21 | 0.033 | 0.008 |
| Soda ash without residue | — | " | 3.6 | 0.08 | 0.19 | 0.031 | 0.008 |

We claim:

1. A method for continuously refining a molten iron base metal, wherein the combination of dephosphorization and desulfurization occurs in a single stage, which method comprises continuously introducing the metal to be thus refined into a refining vessel which is substantially closed to the atmosphere outside said vessel and simultaneously therewith introducing a flux containing at least 50% of an alkali metal carbonate-containing salt into said vessel to refine said metal under oxidizing conditions; discharging substantially all of the by-product, generated during the refining step, from said vessel; recovering the refined metal; recovering an alkali metal, in the form of an alkali metal carbonate-containing salt, from said by-product; and recycling the recovered alkali metal carbonate-containing salt for use as a flux in the refining step.

2. The method according to claim 1 in which said alkali metal carbonate-containing salt consists essentially of sodium carbonate 3. The method according to claim 1 in which the recovered alkali metal carbonate-containing salt is used together with an alkali metal carbonate-containing salt of other origin.

4. The method according to claim 1 in which the by-product is composed of a slag and a powdery dust consisting essentially of an evaporated material obtained in said refining step.

5. The method according to claim 4 in which the slag is dissolved in water or in a solvent consisting essentially of water to produce a slurry; insoluble residue in removed therefrom; and the resulting aqueous slag solution is contacted with $CO_2$ so that the alkali metal is recovered as the carbonate-containing salt.

6. The method according to claim 5 in which at least one member selected from the group consisting of sulfur compound, phosphorus compound and silicon compound is removed from the aqueous slag solution and the resulting solution is contacted with $CO_2$ so that the alkali metal is recovered as the carbonate-containing salt.

7. The method according to claim 6 in which the slag solution which has been contacted with $CO_2$ is filtered or evaporated to dryness so as to separate the alkali metal carbonate-containing salt from the solution.

8. The method according to claim 5 in which the slag is dissolved in water containing the alkali metal carbonate-containing salt; and the resulting slurry is contacted with a gas having an oxidizing action so that S becomes insolubilized and is removed together with the insoluble residue.

9. The method according to claim 5 in which the slag if dissolved in water containing the alkali metal carbonate-containing salt; and the resulting slurry is contacted with $CO_2$ until the pH reaches 9–12 so that Si becomes insolubilized and is removed together with the insoluble residue.

10. The method according to claim 6 in which a whole or part of the aqueous slag solution is subjected to a submerged combustion treatment or an ion-exchange membrane electrolysis treatment so that S is removed from said solution.

11. The method according to claim 6 in which an alkaline earth metal phosphate compound is deposited from the aqueous slag solution; and a weak acidic substance is added to said solution, while said deposited phosphate compound is suspended therein, to convert Si compound into insoluble silicic acid so that Si compound is removed from the aqueous slag solution.

12. The method according to claim 4 in which the slag is dissolved in water or in a solvent consisting predominantly of water; the resulting slurry is filtered off; and the alkali metal compound contained in the resulting insoluble residue is recovered.

13. The method according to claim 5 in which the evaporated material emanating inside the refining vessel is collected in a wet type dust collector; and the resulting water is used singly or in combination with other supply water as the solvent for dissolving the slag.

14. The method according to claim 5 in which a liquid obtained by separating the alkali carbonate-containing salt by blowing $CO_2$ into the aqueous slag solution is used singly or in combination with other supply water as the solvent for dissolving the slag.

15. The method according to claim 4 in which the powdery dust is collected by the use of a dry type dust collector; and the alkali metal carbonate-containing salt is recovered from the powdery dust as it is or after it is shaped into larger granules.

16. The method according to claim 1 in which the metal to be refined has a Si content of 0.4% or less.

17. The method according to claim 1 in which the refining under oxidizing conditions is such that the metal to be refined is contacted with at least one member selected from the group consisting of $O_2$ gas, air and iron oxide.

18. The method according to claim 1, in which the refining vessel is a vessel made of refractory material of such structure as to collect an evaporated substance emanating by the oxidizing-refining reaction inside said vessel.

19. The method according to claim 6 in which at least one member selected from the group consisting of the oxides, carbonate, nitrate and hydroxide of an alkaline earth metal is added to the aqueous slag solution to deposit an alkaline earth metal phosphate compound; and said phosphate compound is removed from said solution.

20. The method according to claim 1 in which the amount of the alkali metal carbonate-containing salt to be introduced into the refining vessel is determined by the following equation, where $SiO_2$ and $P_2O_5$ are oxidation products to be formed during the refining:

Alkali metal oxide/($SiO_2$ + $P_2O_5$) = 2 to 7 (mole ratio).

21. The method according to claim 21 in which, prior to the refining step, the molten iron base metal is subjected to desiliconization.

22. The method according to claim 18 in which, after substantially all of said by-product is discharged from the refining vessel, the thus refined metal is subjected to a further slag-removal treatment.

23. The method according to claim 5 in which the slag discharged from the refining vessel is allowed to flow onto a metal plate having a temperature of 300° C or less to permit cooling of the slag; and the cooled slag is crushed and dissolved in water or in a solvent consisting essentially of water.

* * * * *